United States Patent [19]

Wochnowski et al.

[11] 4,241,515

[45] * Dec. 30, 1980

[54] METHOD AND APPARATUS FOR CONDITIONING TOBACCO

[75] Inventors: Waldemar Wochnowski, Hamburg; Reinhard Hohm, Hamburg Bahrenfeld, both of Fed. Rep. of Germany

[73] Assignee: Hauni-Werke Körber & Co. KG, Hamburg, Fed. Rep. of Germany

[ * ] Notice: The portion of the term of this patent subsequent to Mar. 13, 1996, has been disclaimed.

[21] Appl. No.: 922,575

[22] Filed: Jul. 6, 1978

Related U.S. Application Data

[63] Continuation of Ser. No. 448,949, Mar. 7, 1974, Pat. No. 4,143,471, which is a continuation-in-part of Ser. No. 220,599, Jan. 25, 1972, Pat. No. 3,799,176.

[30] Foreign Application Priority Data

Jan. 27, 1971 [DE] Fed. Rep. of Germany ..... 2103671
Jun. 29, 1971 [DE] Fed. Rep. of Germany ..... 2132226
Jul. 14, 1973 [DE] Fed. Rep. of Germany ..... 2335970

[51] Int. Cl.³ ..... F26B 3/08

[52] U.S. Cl. ..... 34/28; 34/32; 34/46; 34/48; 34/50; 34/212; 131/135; 131/140 R

[58] Field of Search ..... 34/28, 32, 26, 46, 50, 34/48, 212, 216, 217; 131/135, 136, 138, 140

[56] References Cited

U.S. PATENT DOCUMENTS

| | | | |
|---|---|---|---|
| 672,806 | 4/1901 | Proctor | 131/136 |
| 2,767,717 | 10/1956 | Schlossmacher | 131/136 |
| 2,768,629 | 10/1956 | Maul | 131/135 |
| 3,254,428 | 6/1966 | Bates | 34/164 |
| 3,372,488 | 3/1968 | Koch et al. | 131/136 |
| 3,389,707 | 6/1968 | Wochnowski | 131/135 |
| 3,475,832 | 11/1969 | Kuelling | 34/182 |
| 3,799,176 | 3/1974 | Wochnowski et al. | 131/140 R |
| 4,143,471 | 3/1979 | Wochnowski et al. | 34/50 |

*Primary Examiner*—Larry I. Schwartz
*Attorney, Agent, or Firm*—Peter K. Kontler

[57] ABSTRACT

The moisture content of tobacco, particularly greenleaf tobacco, is reduced to an accurately determined value by conveying a continuous tobacco stream through three successive sections of a transporting system wherein the tobacco is contacted by air currents. In accordance with a first embodiment, a relatively hot current of air is conveyed countercurrent to the direction of tobacco transport in the first section of the transporting system; in the second section, the flow of hot air is concurrent with the direction of tobacco transport; in the third section, the tobacco is contacted by relatively cool air having a relatively high moisture content. The air which is conveyed through the third section can be withdrawn from the first section, and the temperature of air in the second section is regulated as a function of deviations of moisture content of partially or completely conditioned tobacco from a desired moisture content. The temperature and moisture content of air in the third section are maintained at a constant value to bring about a hygroscopic equilibrium between air and tobacco particles in the third section. In accordance with a second embodiment, the particles of tobacco are subjected to the homogenizing action of moist air currents in the third and/or first section of the transporting system whereby the homogenizing of tobacco in the first section insures that tobacco entering the second section has a uniform moisture content and the homogenizing in third section compensates for eventual lack of uniform drying action in the second section.

6 Claims, 6 Drawing Figures

METHOD AND APPARATUS FOR CONDITIONING TOBACCO

CROSS-REFERENCE TO RELATED APPLICATION

This is a continuation of application Ser. No. 448,949, filed Mar. 7, 1974, now U.S. Pat. No. 4,143,471, which is a continuation-in-part of our copending application Ser. No. 220,599 filed Jan. 25, 1972, now U.S. Pat. No. 3,799,176 granted Mar. 26, 1974.

BACKGROUND OF THE INVENTION

The present invention relates to a method and apparatus for conditioning tobacco particles, and more particularly to a method and apparatus for conditioning tobacco particles in the form of whole leaves, laminae, ribs and stem and/or shreds which preferably form a continuous stream and are transported through a series of conditioning zones. Still more particularly, the invention relates to improvements in a method and apparatus for conditioning tobacco particles by means of a gaseous fluid, preferably air.

It is well known that many treatments of tobacco must be preceded by increasing its moisture content so as to enhance the flexibility of tobacco particles (e.g., prior to shredding) and to thus reduce the likelihood of undesirable breakage or comminution and the formation of dust. It is also known to treat tobacco with a variety of substance (known as casing) in order to improve its aroma; such treatment also involves increasing the moisture content of tobacco. At least some moisture must be expelled from tobacco prior to final processing into cigarettes, cigarillos, cigars, pipe tobacco, chewing tobacco and/or other types of smokers' products. For example, prior to feeding tobacco shreds into a modern mass-producing cigarette making machine, it is necessary to insure that the moisture content of tobacco shreds is invariably within an extremely narrow range which cannot deviate from an optimum moisture content by more than a small fraction of one percent. Heretofore known procedures which are employed in connection with conditioning of tobacco particles normally involve contacting tobacco with a gaseous fluid which is conveyed countercurrent to or concurrently with the direction of tobacco transport through the conditioning apparatus, or a combined concurrent-countercurrent treatment.

The countercurrent treatment involves conveying a current of hot air counter to the direction of transport of tobacco particles and across the tobacco stream. Such treatment is desirable in many instances because the tobacco is treated gently. This is due to the fact that the particles of tobacco are contacted first by a current of hot air at less than maximum temperature, i.e., the hottest portion of the air stream comes into contact with that portion of the tobacco stream which was already treated by cooler air. In other words, the moisture content of tobacco particles is inversely proportional to the temperature of air which contacts successive increments of the stream. As the temperature of air decreases in response to continued contact and energy exchange with tobacco, the moisture content of air rises so that each increment of the tobacco stream is contacted first by an air current having a relatively high moisture content and a relatively low temperature; the moisture content of air decreases and the temperature of air increases in the direction of tobacco transport. Thus, the very hot air contacts those particles of tobacco whose moisture content is already reduced and the relatively cool air contacts tobacco particles whose moisture content is high. Otherwise stated, the maximum exchange of energy takes place at the downstream end of the conditioning zone where the partially conditioned tobacco is contacted by freshly admitted air whose temperature is high. An advantage of such countercurrent conditioning is that the final moisture content of tobacco can be selected and maintained with a high degree of accuracy because, if the moisture content in a region slightly ahead of the downstream end of the conditioning zone deviates from the desired optimum moisture content, the temperature of freshly admitted hot air can be readily changed to compensate for such differences without any delay or with negligible delay. However, the just described countercurrent conditioning cannot insure that the moisture content of each portion of each tobacco particle is within the desired range, i.e., the overall moisture content of a batch of tobacco particles is satisfactory but the moisture content is likely to vary from portion to portion of a discrete tobacco particle.

The conditioning of tobacco with a current of hot air which is conveyed concurrent with the direction of tobacco transport involves conveying the tobacco in and often by the current of air. Such treatment renders it possible to achieve a hygroscopic equilibrium between tobacco and air at the downstream end of the conditioning zone, i.e., all portions of each tobacco particle will have a desired moisture content. However, the concurrent treatment exhibits a serious drawback, namely, that the tobacco particles are contacted first by very hot air which effects an abrupt drying of strata adjacent to the external surfaces of tobacco particles. As a result of such treatment, certain types of tobacco are likely to develop hard crusts. Moreover, the intervals between the measurement of moisture content and an effective adjustment in the event that the final moisture content of tobacco is unsatisfactory are very long. Thus, if the moisture content of tobacco is measured downstream of the conditioning zone and if such moisture content is unsatisfactory, it takes a relatively long interval of time to change the moisture content by changing the characteristics of the air current. This means that a substantial amount of tobacco is allowed to leave the conditioning zone with a final moisture content which is unsatisfactory for further processing. Also, the regulating system which is used to change the characteristics of an air current flowing concurrent with the direction of tobacco transport is likely to begin to oscillate. Since the main drying action takes place in the relatively short foremost portion of the conditioning zone, it is difficult to influence the moisture content of tobacco in the remaining portion of the conditioning zone if such moisture content is unsatisfactory.

The combined concurrent-countercurrent conditioning of tobacco exhibits the advantage that the adverse effects of the preceding (concurrent) treatment can be compensated for during the next-following (countercurrent) treatment. However, this takes place at the expense of uniformity of moisture content in all portions of tobacco particles which leave the conditioning zone. Thus, the countercurrent treatment which follows the concurrent treatment is likely to reduce the uniformity of moisture content in each portion of a tobacco particle which leaves the treating apparatus. Furthermore, even though the concurrent treatment allows for convenient elimination of substantial deviations of measured moisture content from a desired moisture content by proper regulation of the temperature of air currents which are transported concurrent with tobacco particles, such concurrent treatment is likely to bring about undesirable incrustation of tobacco particles in that portion of the cnditioning zone where a current of very hot air comes into contact with tobacco. Therefore, conditioning apparatus whose operation is based on the just discussed principle have failed to find widespread acceptance in the tobacco industry.

Freshly gathered tobacco leaves are normally dried at the farm. Prior to compacting of leaves in barrels, hogsheads or in the form of bales (this is the customary form of moisture content of tobacco leaves must be reduced to an accurately determined relatively low value. Such accurate drying cannot be achieved by mere exposure of tobacco leaves to atmospheric air because various portions of tobacco leaves lose their moisture content at a different rate. Thus, the laminae will dry much faster than ribs and stem. Therefore, freshly gathered tobacco leaves are often stemmed or destalked to separate laminae from stem so that the thus separated stem and laminae can be dried independently of each other. Tobacco which is subjected to a drying action after gathering is often called greenleaf tobacco. Accurate drying of greenleaf tobacco (so that the moisture content of each tobacco particle and of each portion of each tobacco particle remains within a narrow range) is desirable and necessary because, after the tobacco is compacted in barrels or in the form of bales, batches with a higher moisture content tend to mildew and the molding spreads very rapidly throughout an entire barrel or bale to cause substantial damage. A contemporary drying apparatus for greenleaf tobacco normally comprises a rotary open-ended vessel or barrel through which a stream of tobacco is conveyed with a current of air with attendant agitation of tobacco to insure more satisfactory exchange of energy between air and tobacco particles. It is also known to employ drying apparatus in the form of pneumatic conveyors wherein greenleaf tobacco is conveyed in a current of hot air passing through a pipe or the like.

Since a bale or barrel of dried greenleaf tobacco is likely to remain in storage for extended periods of time, the manufacturers require that the moisture content of such tobacco be maintained within an extremely narrow range because a very small nest of mildewy tobacco is likely to contaminate the contents of an entire barrel or an entire bale before the barrel or bale is removed from storage. As mentioned before, the moisture content must be reduced to a very low value, and the transport through a drying or conditioning apparatus wherein the moisture content is reduced to such low value is likely to result in undesirable breakage or comminution of tobacco and/or in the formation of excessive quantities of tobacco dust. The likelihood of breakage or dust formation is particularly pronounced in the aforementioned drying apparatus wherein a stream of tobacco is conveyed through a revolving open-ended vessel in the presence of hot air. This is due to the fact that the revolving vessel subjects the particles of tobacco to a very pronounced agitating action during which the particles are repeatedly lifted well above the bottom zone of the vessel by orbiting rakes or blades and are allowed to drop by gravity back into the bottom zone. Nevertheless, many tobacco growers still employ such types of drying apparatus because their conditioning action is more uniform than that of pneumatic drying apparatus.

Additional problems in connection with conditioning of tobacco arise due to the fact that the space in a modern tobacco processing plant is at a premium. Thus, the manufacturers strive to accommodate the conditioning apparatus in a small area while simultaneously desiring a high output and an accurate conditioning of each and every tobacco particle, i.e., the temperature and/or moisture content of conditioned tobacco should equal or should be very close to an optimum temperature and moisture content. This can be achieved if the dimensions of conditioning apparatus can be increased at will, i.e., if the drying of moist tobacco can be carried out while the particles of tobacco are advanced at a relatively low speed and through a relatively long conditioning zone so that the reduction of moisture content can be achieved gradually. In other words, a satisfactory reduction of moisture content and a satisfactory heating or cooling of tobacco presents no problems if the changes in such characteristics are effected at a slow rate, namely, if the extent of drying per unit length of the conditioning apparatus and per unit of time is relatively small. Such treatment insures reliable homogenization of the final product so that the temperature as well as the moisture content of each particle issuing from the conditioning zone is best suited for further processing. This is due to the fact that a conditioning for a long period of time and in a relatively long conditioning zone can readily compensate for fluctuations in initial temperature and/or moisture content as well as for eventful fluctuations in the intensity of treatment during one In certain presently known tobacco conditioning apparatus, a relatively short heating zone is followed by a homogenizing zone whose function is to eliminate eventual variations in moisture content of tobacco which issues from the drying zone. Such procedure is satisfactory only if the initial moisture content of tobacco (i.e., of tobacco which enters the drying zone) is constant or deviates only slightly from a fixed value. It has been found that the just described conditioning apparatus fail to insure a satisfactory homogenization and cannot achieve a reduction of moisture content to a fixed value unless the initial moisture content is constant or deviates only negligibly from a fixed value. Thus, fluctuations of initial moisture content are likely to adversely influence the drying action or to prevent a satisfactory drying to such an extent that the homogenizing or uniformizing treatment cannot cure the defective drying action.

SUMMARY OF THE INVENTION

An object of the invention is to provide a novel and improved conditioning method for regulating the moisture content of tobacco particles which exhibits all advantages but avoids the drawbacks of presently known conditioning methods.

Another object of the invention is to provide a method which can be practiced in connection with the conditioning of a variety of tobacco particles including whole leaves, shreds, tobacco leaf laminae and/or ribs and stem.

A further object of the invention is to provide a method which insures gentle treatment of tobacco particle during expulsion of surplus moisture, which insures a uniform conditioning so that the moisture content of each portion of each tobacco particle is within a desired range when the conditioning treatment is completed, and which renders it possible to reduce the moisture content of greenleaf tobacco and/or other types of tobacco particles (e.g., tobacco shreds) to an accurately determined value which is best suited for further treatment or for placing the tobacco in storage.

Another object of the invention is to provide a novel tobacco conditioning method whose effectiveness is not influenced by eventual minor or substantial fluctuations in moisture content of untreated moist tobacco.

An additional object of the invention is to provide a tobacco conditioning method according to which the final product exhibits uniform characteristics (especially moisture content and temperature) in spite of the fact that the expulsion of surplus moisture is completed in a small area, within a short interval of time, and while the material to be treated is transported at a high speed.

A further object of the invention is to provide a tobacco conditioning method according to which any and all fluctuations in initial moisture content can be eliminated prior to expulsion of surplus moisture and according to which the drying of tobacco within a short interval of time and while the tobacco is transported at a high speed cannot adversely influence the characteristics of the final product whose homogeneousness at least matches but normally exceeds that of a product which is being treated in relatively long, bulky and slow conditioning apparatus of conventional design.

An additional object of the invention is to provide a novel and improved apparatus which can be utilized for the practice of the above-outlined conditioning method and wherein the explusion of surplus moisture from tobacco particles can be regulated and otherwise controlled by resorting to relatively simple, accurate, compact and reliable control means.

Another object of the invention is to provide a conditioning apparatus wherein the expulsion of surplus moisture need not take up more time than the treatment prior and/or subsequent to drying.

A further object of the invention is to provide a conditioning apparatus which comprises novel and improved means for treating tobacco prior and/or subsequent to expulsion of surplus moisture.

Another object of the invention is to provide the conditioning apparatus with novel and improved means for regulating the drying of tobacco in dependency on fluctuations of the characteristics of untreated tobacco.

Still another object of the invention is to provide novel and improved means for transporting tobacco during expulsion of surplus moisture.

Another object of the invention is to provide novel and improved conditioning devices which can be utilized in the apparatus to effect a controlled reduction of moisture content in various types of tobacco particles including greenleaf tobacco.

One feature of the invention resides in the provision of a method of drying tobacco with a gaseous fluid which comprises transporting moist tobacco particles along a predetermined path, subjecting the particles to the action of a moist first gas current (preferably air) which is conveyed at least substantially transversely of a first portion of the path so that the direction of gas flow has a component substantially at right angles to the direction of tobacco transport, and thereupon subjecting the particles of tobacco to the action of a hot second gas current (preferably air) which is conveyed transversely of a second portion of the path so that the direction of movement of the second current has a component substantially at right angles to the direction of tobacco transport. p The transporting step may comprise vibrating or otherwise agitating the particles of tobacco in at least one portion of the path so that the particles in the one portion of the path are transported in the form of a layer of agitated floating particles. The speed of at least one of the gas currents is preferably reduced during contact with tobacco particles in the respective portion of the path so that the current or currents cannot remove particles from the path.

The particles of tobacco can be subjected to the action of a third gas current while advancing along a third portion of the path. The third current is preferably conveyed transversely of tobacco particles in the third portion of the path and is preferably maintained in a state of hygroscopic equilibrium with the particles in the third portion of the path.

Another feature of the invention resides in the provision of a method of drying tobacco which comprises feeding a continuous stream of tobacco particles into an elongated path, transporting the particles along the path, subjecting the particles to the homogenizing action of a heated first gas current (preferably air) in a first portion (first homogenizing zone) of the path including establishing a state of exact or substantial hygroscopic equilibrium between the first current and tobacco particles in the first portion of the path, reducing the moisture content of tobacco particles in a second portion of the path (for example and preferably by contacting the particles with hot air or another suitable gas which flows transversely of the tobacco stream in the second portion of the path), subjecting the particles to the action of a heated second gas current (preferably air) in a third portion (second homogenizing zone) of the path including establishing a state of hygroscopic equilibrium between the second current and the particles of tobacco in the third portion of the path, and removing the thus dried and homogenized stream of tobacco particles from the path.

The just described method may further comprise the steps of measuring the moisture content of tobacco particles upstream of the first portion of the path and changing the moisture content of the first current in response to changes in measured moisture content of tobacco particles; this insures a desirable homogenizing action in the first portion of the path, i.e., prior to expulsion of moisture in the second portion of the path. In other words, the first gas current need not change the characteristics of the main portion of tobacco but merely the characteristics of those minor portions (if any) whose characteristics deviate from the characteristics of the main portion.

Still further, the just described method may comprise the steps of measuring the moisture content of tobacco particles downstream of the third portion of the path, comparing the measured moisture content with a predetermined optimum or desirable moisture content, and changing the extent of reduction of moisture content in the second portion of the path when the measured moisture content deviates from the predetermined moisture content.

The step of establishing a state of hygroscopic equilibrium between the second current and the particles of tobacco in the third portion of the path may include maintaining the moisture content of the second current in a predetermined relationship with a predetermined desired or optimum moisture content of tobacco particles which leave the third portion of the path. This insures that the second current need not change the characteristics of the main portion of dried tobacco but only the characteristics of that or those minor portions (if any) whose characteristics deviate from the desirable characteristics of the main portion. The homogenizing action of the second gas current is automatic and takes up a short period of time.

The aforedescribed second method may further comprise the steps of measuring the temperature of at least one gas current, comparing the measured temperature with a given temperature, and changing the temperatures of the one current when the measured temperature deviates from the given temperature. This also contributes to a rapid and pronounced homogenizing action of the respective gas current.

At least a portion of at least one of the two currents can be circulated along an endless second path which intersects the respective portion of the elongated path for tobacco particles.

The transporting step of the second drying method may comprise agitating the particles of tobacco in at least one of the first and third portions of the path for tobacco particles so that the respective current contacts and passes through a layer of agitated floating particles.

The step of reducing the moisture content of tobacco particles in the second portion of the path may comprise subjecting the particles in the second portion of the path to the action of a heated third gas current which is preferably conveyed in a direction to intersect the second portion of the path for tobacco particles. The particles in the second portion of the elongated path are preferably vibrated or otherwise agitated during contact with the third gas current.

The speed of at least one of the currents is preferably reduced during contact with tobacco particles in the respective (first, second and/or third) portion of the elongated path.

The novel features which are considered as characteristic of the invention are set forth in particular in the appended claims. The improved conditioning apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
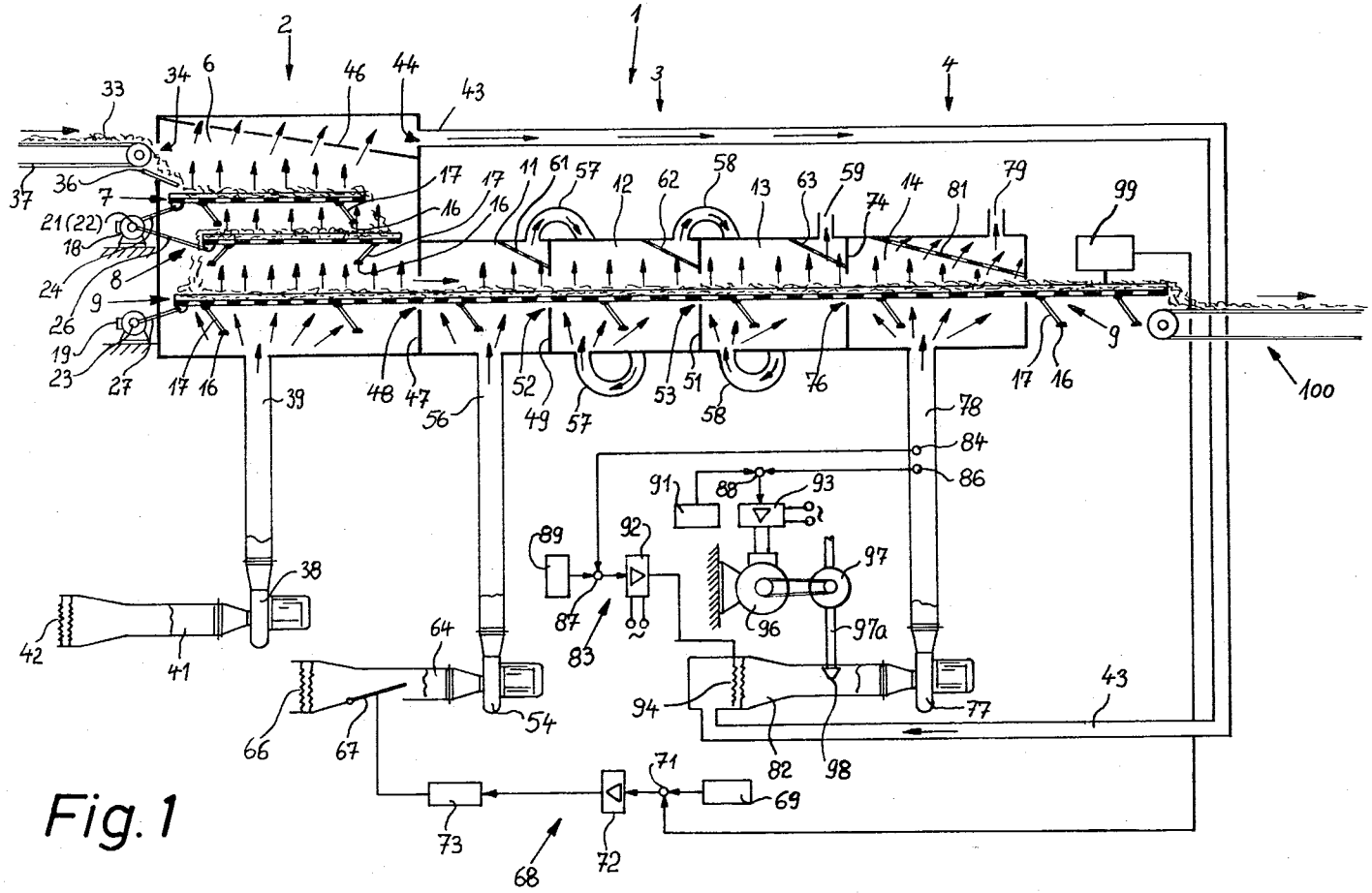
FIG. 1 is a schematic partly elevational and partly sectional view of a conditioning apparatus which embodies one form of the invention.

The conditioning apparatus of FIG. 1 comprises a tobacco transporting system 1 including a first or foremost section 2, a second or intermediate section 3, and a third or rear section 4. The first transporting section 2 comprises a chamber 6 for three discrete vibratory conveyors 7, 8 and 9 which are disposed at different levels, with the conveyor 8 located above the conveyor 9 but below the conveyor 7. The right-hand or discharge end of the uppermost conveyor 7 discharges successive increments of a continuous stream of tobacco particles 33 onto the right-hand end of the median conveyor 8, and the left-hand end of the median conveyor 8 discharges successive increments of the tobacco stream onto the left-hand end of the lowermost conveyor 9. The latter is substantially longer than the conveyors 7, 8 and also extends through and beyond successive chambers 11, 12, 13 of the intermediate transporting section 3 as well as through and beyond the single chamber 14 of the rear transporting section 4. The conveyors 7, 8 and 9 are mounted on sets of carriers 16 by means of pairs of leaf springs 17 (see also FIG. 2). The drive means for vibrating the conveyors 7, 8 comprises an electric motor 18 whose output shaft rotates two eccentrics 21, 22 which are respectively coupled with the conveyors 7, 8 by connecting rods 24, 26. The drive means for vibrating the conveyor 9 comprises a second electric motor 19 whose output shaft drives an eccentric 23 for a third connecting rod 27.

Figure 2:
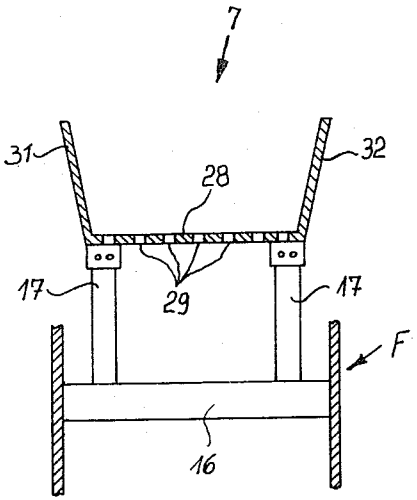
FIG. 2 is an enlarged transverse vertical sectional view of a vibratory conveyor in the conditioning apparatus of FIG. 1.

FIG. 2 shows that the carriers 16 are mounted in the frame F of the conditioning apparatus and that the conveyor 7 comprises a foraminous bottom wall or platform 28 having perforations or holes 29, and two side walls 31, 32 which flank the platform 28 and diverge upwardly and outwardly so that the qidth of the channel whch is defined by the conveyor 7 increases in a direction upwardly and away from the bottom wall 28. The construction of the other two conveyors 8, 9 is identical with that of conveyor 7.

Referring again to FIG. 1, the upper end portion of the left-hand wall of the chamber 6 has an inlet opening 34 onto the left-hand end of the uppermost vibratory conveyor 7. The particles 33 descend onto the conveyor 7 by sliding along an inclined chute 36 which receives tobacco from the upper stretch of a continuously driven conveyor belt 37.

The conditioning apparatus further comprises a first conditioning device having means 41, 38, 39 for circulating through the tobacco particles 33 in the chamber 6 a current of heated air countercurrent to the direction of tobacco travel. The circulating means comprises a blower 38 which is connected with the lower portion of the chamber 6 by a pipe 39 and receives heated air by way of a suction pipe 41 containing a preferably adjustable electric resistance heater 42 which constitutes a means for maintaining a characteristic (the temperature) of the first current within a predetermined range. The inflowing air is heated by the heater 42 and passes through the pipe 41, blower 38 and pipe 39 to enter the chamber 6 below the left-hand portion of the vibratory conveyor 9. The current of hot air passes upwardly through the perforations 29 in the bottom wall 28 of the conveyor 9, thereupon through the median conveyor 8 and finally through the uppermost conveyor 7 to be evacuated by way of an outlet opening 44 located behind a sieve or filter 46 which serves as a means for intercepting those tobacco particles 33 which might be entrained by the ascending air currents. The outlet opening 44 admits air into an elongated pipe or conduit 43. The current of air entering the chamber 6 by way of the pipe 39 is subdivided into a large number of smaller currents during travel through the bottom walls 28 of the conveyors 7, 8 and 9.

The chamber 6 of the first transporting section 2 is separated from the first chamber 11 of the second transporting section 3 by a partition wall 47 having an opening 48 for the conveyor 9. Similar partitions or walls 49, 51, 74 respectively separate the chambers 11–12, 12–13 and 13–14; these partitions are respectively provided with openings 52, 53 and 76 for the conveyor 9. A further opening in the right-hand wall of the chamber 14 in the transporting section 4 serves to permit passage of the conveyor 9 and of the stream of conditioned tobacco particles thereon.

In the transporting section 3, the tobacco particles 33 are treated by a second current of hot air which flows concurrent with the tobacco stream, i.e., through the chambers 11, 12 and 13 in that order. Such second current is induced by a second blower 54 which is connected with the lower portion of the chamber 11 by a pipe 56 and is further connected with a suction plug 64 serving to draw atmospheric air past a preferably adjustable electric resistance heater 66. The suction pipe 64 further contains an adjustable regulating valve 67 here shown as a flap which is pivotable by a servomotor 73 and serves to regulate the temperature of air which enters the pipe 56 and chamber 11 by determining the rate at which the air flowing across the heater 66 is mixed with unheated atmospheric air in the pipe 64. The upper portion of the chamber 11 (above the conveyor 9) is connected with the lower portion of the chamber 12 (below the conveyor 9) by means of a suitable bent conduit or pipe 57, and a similar conduit or pipe 58 connects the upper portion of the chamber 12 with the lower portion of the chamber 13. Sieves or filters 61, 62 are respectively mounted in the chambers 11, 12 below the intake ends of the conduits 57, 58 to prevent the escape of tobacco particles. The upper portion of the chamber 13 is provided with an outlet opening 59, located behind a sieve or filter 63, to permit the escape of spent air into the surrounding atmosphere.

The aforementioned servomotor 73 forms part of a control unit 68 which determines the position of the regulating valve 67 in the suction pipe 64. This control unit 68 further comprises a potentiometer 69 or another suitable rated value setting device which is connected with a signal comparing junction 71. The output signal from the junction 71 is amplified at 72 and is transmitted to the servomotor 73 to be used as a means for determining the setting of the regulating valve 67. It will be seen that the second conditioning device which causes the second air current to flow through the section 3 comprises means 66, 64, 56, 57, 58 for circulating the second current concurrent with the direction of tobacco transport and means 67, 68, 73 for maintaining the temperature of the second current within a predetermined range.

A third conditioning device of the apparatus comprises means 82, 77, 78 for circulating a current of moist heated air across the tobacco stream on the conveyor 9 in the chamber 14 of the third transporting section 4. Such circulating means comprises a blower 77 which is connected with the lower portion of the chamber 14 by a pipe 78. The suction pipe 82 of the blower 77 is connected with the outlet opening 44 of the chamber 6 by means of the aforementioned conduit 43, and the thus admitted air can be heated in the suction pipe 82 by an electric resistance heater 94 which is adjustable by a control unit 83. The latter insures that the characteristics of the air current which enters the pipe 78 and chamber 14 do not change at all or fluctuate within a very narrow range. The control unit 83 comprises two detectors 84, 86 which are mounted in the pipe 78 and respectively serve to measure the temperature and moisture content of the air current flowing into the lower portion of the chamber 14 below the conveyor 9. The detector 84 may be any suitable thermoelement or heat-sensitive conductor (NTC or PTC) which can produce signals indicating the temperature of surrounding air, and the detector 86 may be a conventional hygrometer. The control unit 83 further comprises two signal comparing junctions 87, 88, two potentiometers or analogous rated value setting devices 89, 91, and two output amplifiers 92, 93. Still further, the control unit 83 comprises a variable-speed electric motor 96 which receives signals from the amplifier 93 and drives a variable-delivery pump 97 in a water line **97*a* having an atomizing nozzle 98 mounted in the suction pipe 82 downstream of the heater 94. The source from which the line 97*a* draws water at the rate determined by the speed of the motor 96 is not shown in FIG. 1**.

The fully conditioned tobacco particles 33 on that portion of the conveyor 9 which extends beyond the chamber 14 of the last transporting section 4 travel past a detector 99 which serves to monitor and determine the moisture content of tobacco particles downstream of the chamber 14. The detector 99 may be of the type known as HWK produced by Hauni-Werke, Körber & Co., K.G., of Hamburg-Bergedorf, Western Germany. The signal which is produced by the detector 99 is indicative of the moisture content of conditioned tobacco and is transmitted to the junction 71 of the control unit 68 to be compared with the signal which is furnished by the potentiometer 69. The detector 99, potentiometer 89, junction 71, amplifier 72 and servomotor 73 together form a circuit which determines the moisture content of conditioned tobacco in that the signal furnished by the detector 99 serves to cause the servomotor 73 to adjust the regulating valve 67 when the intensity of the signal from detector 99 is different from that of the signal furnished by the potentiometer 69, i.e., when the moisture content of tobacco downstream of the chamber 14 deviates from a desired predetermined moisture content as represented by the signal from the potentiometer 69.

A take-off conveyor 100 (e.g., an endless belt) serves to transport conditioned tobacco to a further processing station, not shown.

The operation:

The conveyor belt 37 delivers a continuous stream of tobacco particles 33 onto the chute 36 which in turn delivers such particles into the channel between the walls 28, 31, 32 of the uppermost vibratory conveyor 7 in the chamber 6 of the first transporting section 2. The conveyor 7 transports the tobacco stream lengthwise in a direction to the right, and the stream thereupon reverses the direction of its movement during transport on the median conveyor 8 to again move in a direction to the right while moving between the walls 28, 31, 32 of the conveyor 9. The latter transports the tobacco stream through the opening 48 in the partition 47 and into and through successive chambers 11, 12 and 13 of the median transporting section 3.

The blower 38 delivers into the pipe 39 a continuous current of hot air whereby such air flows upwardly through the perforations 29 in the bottom wall 28 of the conveyor 9, thereupon through the bottom wall 28 of the conveyor 8 to pass finally through the bottom wall 28 of the conveyor 7 to pass through the interstices of the sieve 46 and to leave the chamber 6 by way of the outlet opening 44 prior to entering the conduit 43 on its way into the inlet of the suction pipe 82. As the current of air passes through the bottom walls 28 of the three conveyors 7, 8 and 9, the resulting smaller currents of hot air agitate tobacco particles 33 on the respective conveyors to bring about a thorough heating action. It will be noted that the flow of hot air in the chamber 6 is countercurrent to the direction of transport of tobacco particles 33 because the hot air first impinges on tobacco which is being transported by the lowermost conveyor 9, i.e., by the conveyor which is remotest from the inlet opening 34, thereupon on tobacco which is being transported by the median conveyor 8, and finally on tobacco which is being transported by the uppermost conveyor 7. Actually, the flow of hot air takes place at right angles to the direction of transport of tobacco particles 33, but only when considered in a relatively small portion of each of the three troughs formed by the walls 28, 31 and 32 of the respective vibratory conveyors.

The connecting rods 24, 26 and 27 transmit to the walls 28, 31, 32 of the respective conveyors 7, 8 and 9 recurrent movements which cause the particles of tobacco to "bounce" on the respective bottom walls 28. Such bouncing or rebounding of particles 33 is further assisted by small currents of hot air which flow upwardly through the perforations 29 whereby the particles in the channels of the three vibratory conveyors 7–9 form three layers of highly agitated tobacco. Such mode of transport and treatment is highly desirable because the entire external surface of each tobacco particle is repeatedly brought into contact with surrounding hot air to thereby insure a highly effective exchange of energy between tobacco and hot air.

Since the side walls 31, 32 of the conveyors 7–9 diverge upwardly, i.e., in the direction of flow of currents of hot air across the tobacco stream, the speed of such air currents decreases in the same direction which is desirable because the decelerated air currents are less likely to entrain lighter tobacco particles toward the sieve 46. The countercurrent flow of hot air in the chamber 6 is desirable because the particles 33 which enter the chamber 6 by way of the inlet opening 34 are not immediately subjected to the action of very hot air. On the contrary, very hot air first comes into contact with particles 33 on the conveyor 9, i.e., with particles which were preheated by hot air at less than maximum temperature on the conveyor 8 and with even less hot air on the conveyor 7. This reduces the likelihood of the formation of hard crusts along the external surfaces of tobacco particles in the transporting section 2.

The temperature of air currents passing through the interstices of the sieve 46 and into the conduit 43 is normally substantially less than the temperature of air in the pipe 39, and the air in the conduit 43 is enriched with moisture which is being withdrawn from tobacco particles 33 on the conveyors 7–9. The conveyor 9 transports the pretreated tobacco particles 33 from the chamber 6, through the opening 48 in the partition 47 and into the first chamber 11 of the second transporting section 3, thereupon into the second chamber 12, into the third chamber 13 and finally into and through the chamber 14 of the third transporting section 4. During travel across the chamber 11, the tobacco particles 33 are agitated by the bottom wall 28 of the conveyor 9 as well as by small currents of hot air which is supplied by the blower 54 by way of the pipe 56 and flows through the perforations 29 toward and through the interstices of the sieve 61 to enter the conduit 57 on its way into the lower portion of chamber 12. The small currents of air which pass through the perforations 29 of the bottom wall 28 in the chamber 12 thereupon pass through the seive 62 and conduit 58 to enter the lower portion of the chamber 13, to pass again through the conveyor 9, thereupon through the sieve 63 and to discharged into the atmosphere by way of the outlet opening 59. The flow of air currents across the tobacco stream in the chambers 11–13 takes place substantially at right angles to the direction of transport of tobacco particles; however, since the air current first enters the chamber 11 and thereupon passes across the chambers 12 and 13, the overall flow of such air is concurrent with the direction of tobacco travel through the transporting section 3.

The tobacco stream which passes across the chamber 14 of the transporting section 4 is treated by currents of moist hot air which is delivered by the blower 77 by way of the pipe 78. Such air currents pass through the perforations 29 of the bottom wall 28 in the chamber 14, thereupon through a sieve 81, and are discharged by way of an outlet opening 79. The moisture content of air which is admitted into the chamber 14 via pipe 78 is due to the fact that such air is delivered into the pipe 82 by way of the conduit 43 and also due to the provision of the atomizing nozzle 98 which delivers a spray of water into the pipe 82 downstream of the heater 94 at the rate determined by the speed of the electric motor 96. The condition of air which is supplied by the pipe 78 preferably corresponds exactly to the desired condition of tobacco which leaves the chamber 14 on its way toward the take-off conveyor 100, i.e., the moisture content and/or temperature of such air can be selected with a view to match or at least to closely approximate the desired moisture content and/or temperature of conditioned tobacco particles 33. Such treatment of air which enters the chamber 14 insures the establishment of hygroscopic equilibrium between the air in the transporting section 4 and the tobacco particles 33; this is desirable in order to insure that the moisture content is uniform in each portion of each tobacco particle which leaves the chamber 14.

The detector 84 in the pipe 78 produces signals which are indicative of the temperature of air supplied by the blower 77, and such signals are transmitted to the junction 87 to be compared with the signal furnished by the potentiometer 89 which is adjusted so that its output signal represents the desired temperature of tobacco particles 33 on the conveyor 9 downstream of the chamber 14. When the temperature of air in the pipe 78 exceeds the desired temperature of conditioned tobacco, the junction 87 transmits a signal to the amplifier 92 which adjusts the heater 94 so that the air current which is supplied by the conduit 43 is subjected to a less intensive heating action. Inversely, when the temperature of air in the pipe 78 is too low, the signal which is furnished to the amplifier 92 is indicative of the difference between the intensities of signals from the detector 84 and potentiometer 89, and the heating action of the heater 94 upon air which is admitted into the pipe 32 by way of the conduit 43 is intensified accordingly.

The detector 86 produces signals which are indicative of the moisture content of air in the pipe 78; such signals are transmitted to the junction 88 which compares them with the signal furnished by the potentiometer 91. Depending on the positive or negative sign of the difference between the intensities of signals furnished by the detector 86 and potentiometer 91, the junction 88 transmits to the amplifier 93 signals which cause a deceleration or acceleration of the motor 96 with the result that the pump 97 delivers to the nozzle 98 larger or smaller quantities of water per unit of time. It will be noted that the control unit 83 automatically regulates the condition of air in the pipe 78 to match or to closely approximate at least one desired characteristic of tobacco particles 33 on the conveyor 9 downstream of the chamber 14.

An advantage of the control unit 83 is that it can effect rapid changes in the temperature and/or moisture content of air in the pipe 78 because the suction pipe 82 receives a continuous current of preconditioned air, namely, a current of air which is preheated because it has already passed across the heater 42 and which contains moisture because it has been in contact with tobacco in the chamber 6. Consequently, the condition of air in the pipe 78 can be changed practically without any delay to thus insure that the temperature and/or moisture content of all portions of the tobacco stream which leaves the chamber 14 deviates little from or is identical with an optimum value. Moreover, the energy requirements of the control unit 83 are relatively low because such unit must insure an optimum temperature and moisture content of a preconditioned air current. Still further, the delivery of preheated and humid air from the chamber 6 into the suction pipe 82 reduces the overall air requirements of the apparatus with attendant savings in cost.

After the tobacco stream leaves the chamber 14, its particles 33 move past the detector 99 which produces signals indicating the moisture content of conditioned tobacco. Such signals are transmitted to the junction 71 and are compared with the signal from the potentiometer 69. If the two signals differ in intensity, the junction 71 transmits a signal to the amplifier 72 which causes the servomotor 73 to change the position of the regulating valve 67 and hence the temperature of air in the pipe 56. The detector 99 cooperates with the control unit 68 to effect very accurate changes in the moisture content of tobacco particles 33 by regulating the heating action of air currents in the chambers 11–13 of the intermediate transporting section 3. It will be noted that the detector 99 influences the conditioning action in the intermediate, rather than the last, transporting section of the system 1.

The conveyor 9 delivers conditioned tobacco onto the upper stretch of the take-off conveyor 100 which transports such material to one or more additional treating stations, not shown.

By way of example, the conditioning apparatus of FIGS. 1 and 2 can be designed to process 2,500 kilograms of tobacco per hour. The initial moisture content of tobacco particles 33 (on the belt 37) may be about 19 percent, the overall length of the chamber 6 (as considered in the direction of tobacco transport on the conveyor 7, 8 or 9) may be about 150 centimeters, the overall length of the transporting section 3 may be about 150 centimeters and the length of the transporting section 4 may be about 250 centimeters. The width of the chambers 6 and 11–14 may be about 80 centimeters and the speed at which the currents of air are conveyed through these chambers may be about 110 centimeters per second. The temperature of air which enters the chambers 6 and 11 may be about 180° C. The temperature of air which enters the chamber 14 may be 25° C. and its moisture content may be about 60 percent. The final moisture content of tobacco at the downstream end of the conveyor 11 (below the detector 99) may be 12 percent. It is clear that the above values will vary with changes in the rate of tobacco delivery, with the nature of tobacco, with the desired final moisture content of tobacco and/or other factors. Moreover, the temperature of air currents in the transporting sections 2 and 3 can be reduced if the speed of tobacco transport is reduced or vice versa; the length of the section 2 may differ from the length of the section 3; the number of chambers in the section 3 may be reduced or increased; and the conditioning medium can be a gaseous fluid other than air. Also, the conveyor 7, 8 and/or 9 can be replaced by two or more conveyors and the heater 42, 66 and/or 94 can be replaced by other types of heating devices. For example, at least the transporting sections 2 and 3 may employ tobacco conveyors in the form of open-ended revolving drums or endless foraminous belts. These are but a few examples of various modifications which can be carried out within the purview of the invention.

It will be seen that the method which can be performed by resorting to the apparatus of FIGS. 1 and 2 differs from conventional methods in that the particles 33 of tobacco are subjected to the action of a first current of gaseous fluid which is conveyed countercurrent to the direction of travel of particles in a first portion of the path defined by the transporting system 1 (namely, in the transporting section 2) and whose characteristics (particularly its rate of flow and its temperature) are maintained within a predetermined range (e.g., at or about 110 centimeters per second and 180° C.), and that the particles 33 are thereupon subjected to the action of a second current of a gaseous fluid which is conveyed concurrent with the direction of travel of tobacco particles in a second portion of the path (namely, in the portion defined by the transporting section 3) located downstream of the first portion and whose characteristics (particularly its rate of flow and its temperature) are also maintained within a predetermined range (e.g., at or about 110 centimeters per second and 180° C.). Furthermore, the particles 33 are subjected to the action of a third current of a gaseous fluid in a third portion of the path located downstream of the second portion (namely, in the portion defined by the transporting section 4) and the characteristics of the third current (particularly its temperature and moisture content) are maintained within a predetermined range (e.g., at or about 25° C. and at or about 60 percent).

The conditioning in the second transporting section 3, which follows the conditioning in the transporting section 2, exhibits the advantage that the tobacco leaving the chamber 13 can be brought into hygroscopic equilibrium with the gaseous fluid which contacts the particles 33 in the section 4. In certain instances, it suffices to condition the tobacco particles with only two currents of a gaseous fluid, namely in the sections 2 and 3 of the transporting system 1. However, such procedure cannot always insure practically instantaneous correction for eventual deviations of final moisture content from a desired or predetermined moisture content. In other words, were the chamber 14 omitted, it would require a longer interval of time to change the moisture content of tobacco particles 33 which leave the chamber 13 if the moisture content of such particles would be higher or less than the desired moisture content. The provision of the transporting section 4 and of the conditioning means for gaseous fluid which is supplied into the chamber 14 by way of the pipe 78 renders it possible to reduce the length of intervals which are needed to eliminate eventual deviations of final moisture content from a desired moisture content. This is achieved by selecting at least one characteristic of the gaseous fluid which enters the chamber 14 in such a way that it matches or closely approaches the desired corresponding characteristic of the particles 33 on the conveyor 100.

The provision of the conduit 43 reduces the energy requirements of the apparatus because this conduit conveys the once-used gaseous fluid from a preceding transporting section (2) into a next-following transporting section (4). It is clear that, if necessary, the chamber 14 can receive at least some air which leaves the chamber 6 and/or at least some air which leaves the chamber 13. Fluctuations in the moisture content of tobacco which leaves the chamber 14 are reduced due to the provision of the detector 99 which influences the characteristics of at least one of the three currents of gaseous fluid; in the embodiment of FIGS. 1 and 2, the detector 99 influences the temperature of air which is being admitted into the chamber 11 of the transporting section 3. The vibratory conveyors 7–9 insure an optimum exchange of energy between tobacco particles 33 and the air currents by agitating the particles during transport through the chambers 6 and 11–14 to thus insure that each air current can intimately contact all sides of each particle.

It has been found that the air currents which pass through the conveyors 9, 8 and 7 in the chamber 6 effect a highly desirable homogenization of tobacco which enters the section 3. This is due to the fact that air currents passing through the conveyor 9 are enriched with moisture by contact with tobacco particles on the conveyor 9 and thereupon by contact with tobacco particles on the conveyor 8 to such an extent that air which contacts the particles on the conveyor 7 is in a state of substantial or virtual hygroscopic equilibrium with tobacco supplied by the chute 36. Thus, air currents ascending through the holes 29 in the bottom wall 28 of the foraminous conveyor 7 eliminate eventual fluctuations in the moisture content of tobacco particles entering the chamber 6 via inlet opening 34 so that the moisture content of tobacco entering the first chamber 11 of the section 3 is at least substantially uniform. This contributes significantly to the uniformity of drying action in the chambers 11, 12 and 13, and renders it possible to reduce the dimensions of the section 4 and/or 3 since the currents of air entering the sections 3 and 4 treat a homogeneous or substantially homogeneous material.

The section 2 can be be said to constitute that portion of the apparatus wherein the product is homogenized prior to expulsion of the major part of surplus moisture while insuring that the particles of tobacco retain their desirable mechanical properties, such as suppleness or flexibility and resistance to breakage during transport in the form of a stream which floats in the troughs of the conveyors 7, 8 and 9. This is attributable to the establishment of substantial or exact hygroscopic equilibrium between the major part of tobacco and air current, either in the conveyor 8 but not later than in the conveyor 7, whereby such equilibrium insures that the moisture content of tobacco in the conveyor 8 and/or 7 changes only in those portions of the tobacco stream whose moisture content deviates from the moisture content of the bulk of tobacco entering the chamber 6 via inlet opening 34. Consequently, hot air which enters the chambers of the section 3 can expel moisture from a homogeneous tobacco stream which contributes significantly to a more uniform and reproducible drying action.

Figure 3:
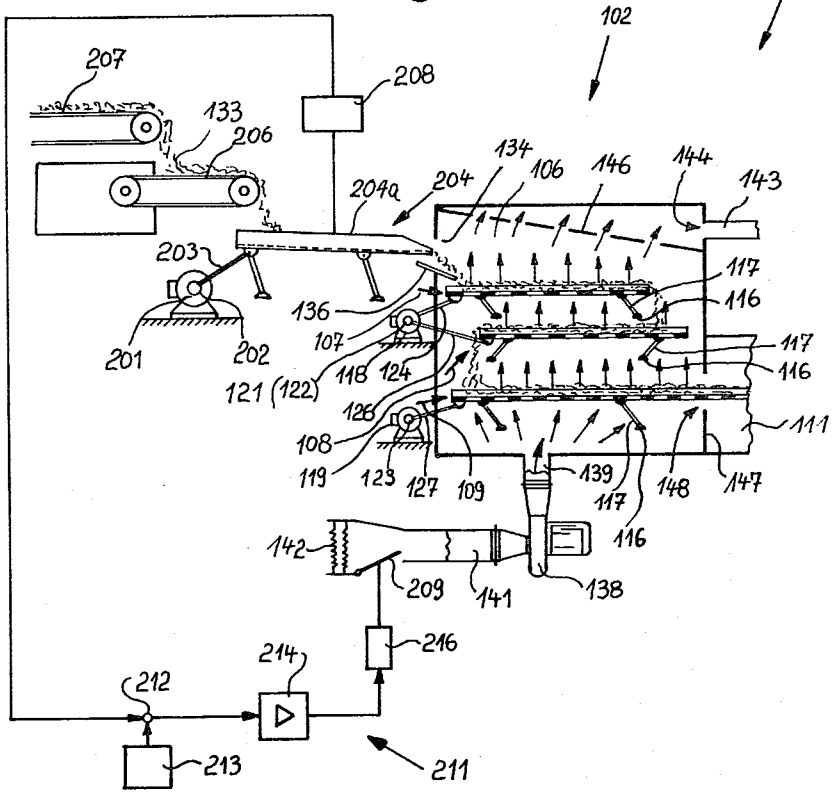
FIG. 3 is a fragmentary schematic partly elevational and partly sectional view of a second conditioning apparatus.

FIG. 3 illustrates a portion of a second conditioning apparatus which differs from the apparatus of FIG. 1 mainly in that the belt conveyor 37 is replaced with a further vibratory conveyor 204 serving to deliver tobacco particles 133 in the form of a continuous stream through the opening 134 and onto the uppermost vibrating conveyor 107 in the chamber 106. All such parts of the second apparatus which are identical with or clearly analogous to the corresponding parts of the first apparatus are denoted by similar reference characters plus 100. Furthermore, the conditioning apparatus of FIG. 3 comprises detector means 208 which determines the moisture content of tobacco particles 133 prior to entry of such particles into the chamber 106. FIG. 3 merely shows the first section 102 of the transporting system 101, the other two sections being assumed to be identical with the sections 3 and 4 of the system 1 shown in FIG. 1.

The trough **204*a* of the conveyor 204 is vibrated by a connecting rod 203 which receives motion from an eccentric 202 on the output shaft of a variable-speed electric motor 201. The trough 204*a* is preceded by a metering device including a weighing conveyor belt 206 which receives a continuous stream of tobacco particles 133 from a further belt conveyor 207. The weighing conveyor 206 is of known design; it is operated in such a way that it delivers to the trough 204*a*** unit quantities of tobacco particles per unit of time. Such weighing conveyors are used in many types of tobacco processing plants to insure constant delivery of tobacco to conveyors, hoppers or the like. Suitable weighing conveyors are produced by the Firm Kukla of Vöcklabruck, Austria, under the designation DWB.

The moisture detector 208 for tobacco in the trough **204*a* is preferably of the same type (HWK) as the moisture detector 99 of FIG. 1. The suction pipe 141 for the blower 138 which delivers hot air into the lower portion of the chamber 106 is provided with a regulating valve 209 similar to the valve 67 of FIG. 1 and having a flap which is pivotable by a servomotor 216. The latter forms part of a control unit 211 which receives signals from the moisture detector 208 and further includes a potentiometer 213 or an analogous rated value setting device, a signal comprising junction 212 and an amplifier 214. The regulating valve 209 can change the ratio of hot air which has been heated by the heater 142 at the intake end of the suction pipe 141 to unheated atmospheric air which is admitted by the valve 209 to thus change the temperature of air which is caused to flow into the chamber 106**.

The operation of the conditioning apparatus which includes the structure of FIG. 3 is as follows:

The belt conveyor 207 delivers a continuous stream of tobacco particles 133 onto the metering conveyor belt 206 which weighs successive increments of tobacco and delivers it at a constant rate into the trough **204*a***.

This insures that the rate of delivery of tobacco particles onto the uppermost vibratory conveyor 107 in the chamber 106 is constant. Such particles reach the foraminous bottom wall of the conveyor 107 by way of the chute 136 and thereupon descend onto the conveyors 108, 109 to be transported into, through and beyond the intermediate and rear sections of the transporting system 101 in the same way as described in connection with FIG. 1.

The detector 208 determines the moisture content of tobacco in the trough 204*a* and produces signals which are transmitted to the junction 212. The latter also receives a signal from the potentiometer 213; such signal indicates the desired or normal initial moisture content of tobacco particles 133. The junction 212 transmits to the amplifier 214 a signal when the signal from the detector 208 differs from the signal furnished by the potentiometer 213, and the amplifier 214 then causes the servomotor 216 to adjust the valve 209 to effect a more or less intensive heating action in the chamber 106. The purpose of the control unit 211 is to compensate for fluctuations in moisture content of tobacco particles 133 which are being fed into the chamber 106 of the first transporting section 102 by altering the condition of hot air in the pipe 139 in dependency on the condition of incoming tobacco. This insures that the conditions (particularly moisture content) of tobacco which enters the chamber 111 of the intermediate transporting section does not deviate appreciably from a predetermined condition which is best suited to insure that tobacco which leaves the transporting system 101 is maintained at a predetermined temperature and has a predetermined moisture content.

Figure 4:
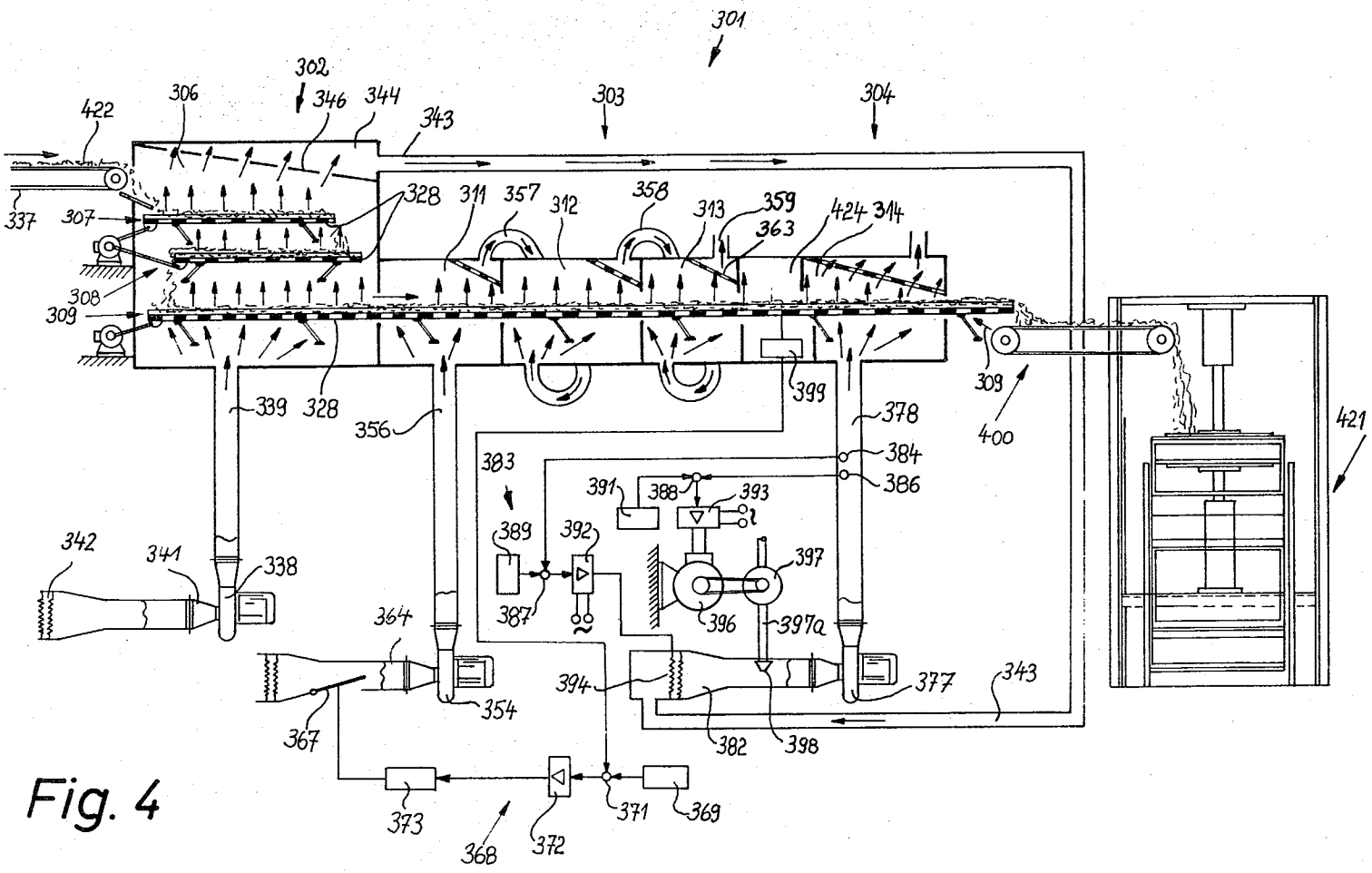
FIG. 4 is a schematic partly elevational and partly sectional view of a third conditioning apparatus which is particularly suited for conditioning and subsequent compacting of greenleaf tobacco.

FIG. 4 illustrates a conditioning apparatus for so-called greenleaf tobacco 422. Such tobacco is supplied in the form of a stream on the upper stretch of a belt conveyor 337 to enter the uppermost vibratory conveyor 307 in a chamber 306 forming part of the first section 302 of a transporting system 301. The conveyor 307 delivers tobacco 422 onto a second vibratory conveyor 308 which, in turn delivers tobacco onto a longer third vibratory conveyor 309 extending through and beyond the sections 302, 303, 304 of the transporting system 301. The section 303 has three chambers 311, 312, 313 and the section 304 has a single chamber 314.

The means for delivering a continuous current of hot air into the lower portion of the chamber 306 is similar to the corresponding means of FIG. 1; it also comprises a blower 338, a suction pipe 341, a heater 342 and a further pipe 339. The construction of all three vibratory conveyors 307, 308, 309 is preferably identical with that of the conveyor 7 shown in FIG. 2. As the bottom walls 328 of the conveyors 307–309 break up the ascending air current in the chamber 306 into smaller air currents which pass through the perforations of the respective bottom walls, such small air currents assist the bouncing action of the bottom walls 328 to insure that the tobacco particles 422 which advance in the vibratory conveyors form layers of agitated particles all sides of each of which are subjected to the action of hot air to insure a uniform drying and moisture-expelling action. This guarantees an optimum exchange of energy between greenleaf tobacco 422 and hot air as well as a gentle treatment of tobacco without excessive breakage or comminution and without any appreciable formation of dust. Since the side walls (not specifically shown) of the conveyors 307–309 diverge in the same way as the side walls 31, 32 shown in FIG. 2, the speed of air currents which pass through the perforations of the bottom walls 328 decreases to thus reduce the likelihood that the lighter tobacco leaves would tend to rise with the air currents toward the screen 346 below the outlet opening 344 which is the intake end of the conduit 343. The latter receives air whose temperature is lower than that of air in the pipe 339 but which has a higher moisture content.

The thus treated tobacco 422 thereupon passes through the chambers 311, 312, 313 of the transporting section 303 and is treated by hot air which is delivered into the chamber 311 by a blower 354 through a pipe 356. The suction pipe 364 of the blower 354 contains a regulating valve 367 whose flap can be pivoted by a servomotor 373 forming part of a control unit 368 which is practically identical with the control unit 68 except that the moisture detector 399 is mounted in an auxiliary chamber 424 located between the chambers 313 and 314. The manner in which the chambers 311–313 are connected with each other (by way of conduits 357, 358) is preferably the same as described in connection with FIG. 1. Spent hot air passes through a sieve 363 in the chamber 313 and is discharged into the atmosphere by way of an outlet opening 359.

The lower portion of the chamber 314 receives hot air which is supplied by a blower 377 through a pipe 378 containing a pair of detectors 384, 386 corresponding to the similarly referenced detectors 84, 86 of FIG. 1. The temperature and/or moisture content of air in the chamber 314 preferably corresponds to the desired temperature and/or moisture content of conditioned greenleaf tobacco 422 which is delivered to a take-off conveyor 400. The suction pipe 382 of the blower 377 contains a heater 394 which is adjustable in the same way as described in connection with the heater 94 of FIG. 1. Therefore, the parts of the control unit 383 are denoted by reference characters similar to those employed in FIG. 1 plus 300. The moisture content of air in the pipe 378 can be varied by the motor 396 which drives the pump 397 in a water line 397*a* the lower end portion of which extends into the suction pipe 382 and is provided with an atomizing nozzle 398.

The conveyor 400 delivers conditioned greenleaf tobacco 422 into a compacting device here shown as a baling press 421 of known design wherein the tobacco is compacted to form bales which are ready for storage. A baling press which can be used in the conditioning apparatus of FIG. 4 is produced by the Firm Heinen of Varel, Western Germany.

The provision of auxiliary chamber 424 and the placing of the moisture detector 399 into such auxiliary chamber insure that the condition of tobacco 422 entering the chamber 314 of the last transporting section 304 can be regulated with an extremely high degree of accuracy. This, in turn, insures that the condition of tobacco 422 leaving the chamber 414 will be maintained within a very narrow range. The signals which are furnished by the detector 399 (such signals indicate the moisture content of tobacco in the chamber 424) are transmitted to the junction 371 of the control unit 368 so that the position of the valve 367 can be changed in dependency on changes in the moisture content of tobacco in chamber 424. Consequently, the conditioning of air which flows through the chambers 311–313 of the transporting section 303 can be selected with a view to insure that the moisture content of tobacco 422 in the auxiliary chamber 424 equals the moisture content represented by the signal from the potentiometer 369 or that, if the moisture content which is detected by the device 399 in the chamber 424 deviates from such desirable moisture content, the condition of tobacco particles 422 can be rapidly changed before the particles enter the final conditioning chamber 314. Therefore, air which is supplied by the blower 377 must compensate only for minor deviations of the moisture content of tobacco from the desired final moisture content as selected by the potentiometer 391.

It is clear that the auxiliary chamber 424 can be used with equal advantage in the conditioning apparatus of FIGS. 1 or 3, i.e., that the final measurement of moisture content of tobacco need not take place downstream of the transporting system but can be carried out during transport of tobacco between the last two sections of the transporting system. This holds true for the conditioning of greenleaf tobacco as well as for the conditioning of other types of tobacco. The actual drying of tobacco particles takes place in the first two sections, and the actual or final conditioning takes place in the rear section of the transporting system.

An important advantage of the apparatus of FIGS. 1–2, 3 and 4 is that the particles of tobacco are subjected to a gentle initial drying action (in the chamber 6, 106 or 306) because such treatment takes place with the help of a current of hot air which flows countercurrent to the direction of tobacco transport. The initial drying is followed by a treatment with hot air which flows concurrent with the direction of tobacco transport (in the section 3, 103 or 303), and finally by establishment of a hygroscopic equilibrium between hot air and tobacco (in the section 4, 104 or 304). The last treatment (in the section 4, 104 or 304) insures that the moisture content is the same in each portion of each tobacco particle.

Another important advantage of the improved method and apparatus is that the transport of tobacco and the conditioning of air which is admitted into the three sections of the transporting system can be regulated in a simple way and with a high degree of accuracy. This is important in connection with the treatment of certain types of tobacco since it is often necessary to maintain the moisture content of tobacco within a very narrow range of a small fraction of one percent. A further advantage of the improved method and apparatus is that the particles of tobacco are treated gently (due to the provision of vibratory conveyors which insure the formation of a layer of agitated tobacco particles) and that the treatment results in uniform drying of all portions of each tobacco particle as well as in minimal breakage or comminution and negligible formation of tobacco dust.

Figure 5:
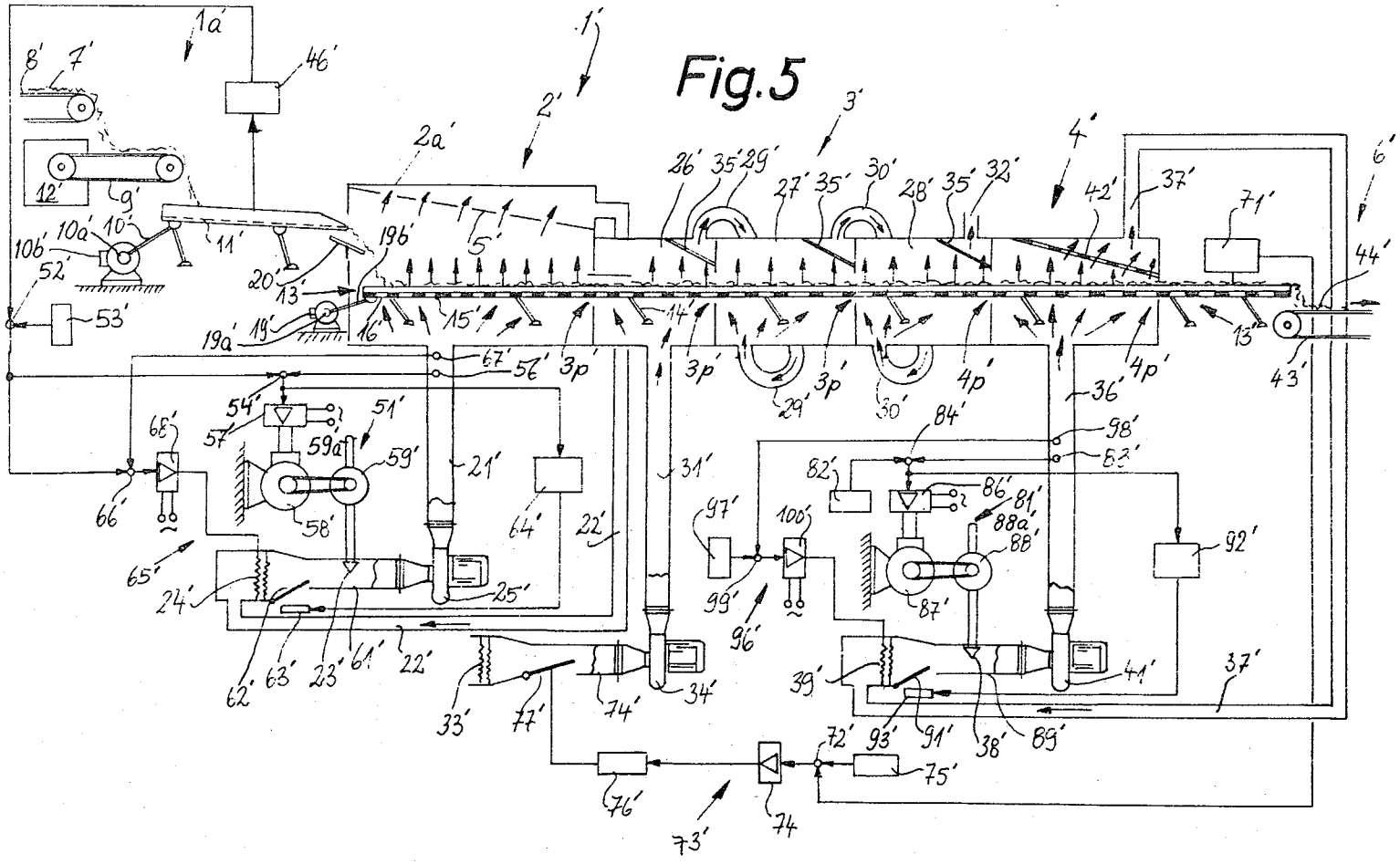
FIG. 5 is a schematic partly elevational and partly sectional view of a fourth conditioning apparatus wherein the particles of tobacco are subjected to a homogenizing action prior and subsequent to expulsion of surplus moisture.

The conditioning apparatus of FIG. 5 comprises a tobacco feeding unit 1*a*′ and a transporting system 1′ including a first homogenizing section 2′ located immediately downstream of the feeding unit 1*a*′, a drying section 3′ located immediately downstream of the secton 2′, and a second homogenizing section 4′ located immediately downstream of the section 3′. The section 4′ is followed by a removing unit 6′ which accepts conditioned tobacco from system 1′.

The feeding unit 1*a*′ comprises a set of three conveyors for a continuous stream of tobacco particles 7′. These conveyors include a first belt conveyor 8′ whose discharge end showers successive increments of the tobacco stream onto the upper stretch of a second belt conveyor 9′, and a vibratory conveyor 11′ having a trough which receives successive increments of the tobacco stream from the discharge end of the belt conveyor 9′. The trough of the conveyor 11′ is vibrated by the eccentric 10*a*′ of an electric motor 10*b*′ through the medium of a connecting rod 10′. The conveyor 9′ forms part of a weighing device 12′ of the aforedescribed character which serves to insure that the trough of the vibratory conveyor 11′ receives tobacco particles 7′ at a uniform or unchanging rate per unit of time.

The conveyor 11′ discharges tobacco particles 7′ onto a downwardly inclined chute 20′ which is installed in an opening provided in the left-hand side wall of a chamber 2*a*′ forming part of the section 2′.

Figure 6:
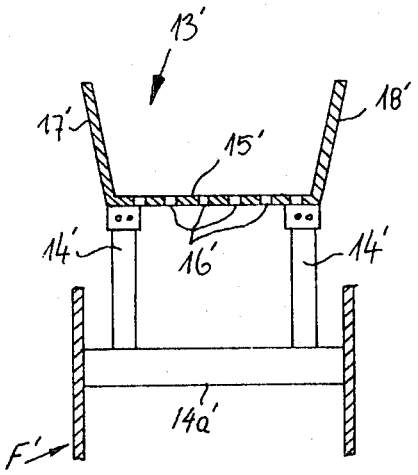
FIG. 6 is an enlarged transverse vertical sectional view of a vibratory conveyor in the apparatus in FIG. 5.

The chamber 2*a*′ of the section 2′ of the transporting system 1′ receives the leftmost part of an elongated vibratory conveyor 13′ a portion of which is illustrated in FIG. 6. The trough of the conveyor 13′ comprises a foraminous bottom wall or platform 15′ having perforations or holes 16′ and being supported by leaf sprinbgs 14′ mounted on a carrier 14*a*′ in the frame F′. The trough of the conveyor 13′ further comprises two side walls 17′, 18′ which diverge upwardly and outwardly in the same way and for the same purpose as described in connection with the side walls 31, 32 of FIG. 2, i.e., to reduce the speed of air currents which flow upwardly through the holes 16′ of the bottom wall 15′ and to prevent such currents from 13′ is substantially horizontal and extends through all three sections 2′–4′ of the transporting system 1′ as well as beyond the section 4′ to deliver conditioned tobacco to the removing unit 6′. The means for vibrating the trough of the conveyor 13′ comprises a variable-speed electric motor 19′ having an eccentric 19*a*′ which transmits motion to the trough by way of a connecting rod 19*b*′.

It is clear that the one-piece vibratory conveyor 13′ of FIGS. 5 and 6 can be replaced by a series of discrete conveyors, for example, by three conveyors, one for each of the sections 2′, 3′ and 4′. At least one of the three conveyors need not be a vibratory conveyor.

The means for tobacco in the section 2′ with a gaseous homogenizing medium comprises a pipe 21′ which communicates with the chamber 2*a*′ at a level below the bottom wall 15′ of the vibratory conveyor 13′. Spent gaseous fluid (preferably air) is withdrawn from the chamber 2*a*′ at a level above the layer of tobacco particles 7′ in the trough of the conveyor 13′ by a pipe or conduit 22′. A sieve or filter 5′ is provided in the chamber 2*a*′ to prevent the homogenizing fluid from entraining lighter tobacco particles into the inlet of the conduit 22′.

The discharge end of the conduit 22′ is connected with the inlet of the pipe 21′ by an air conditioning unit having an atomizing nozzle 23′ for discharging controlled quantities of water into the air current supplied by the conduit 22′, and an adjustable electric resistance heater 24′. The means for circulating air through the chamber 2*a*′ comprises a blower 25′ which draws air from the conduit 22′ and forces the thus withdrawn air into the pipe 21′. The nozzle 23′ and the heater 24′ are installed in a suction pipe 61′ which receives air from the conduit 22′ and supplies air to the inlet of the blower 25′. Air which enters the suction pipe 61′ is heated by the heater 24′ and thereupon receives moisture from the nozzle 23′.

The second section 3′ of the transporting system 1′ comprises three chamber 26′, 27′, 28′ which are separated from each other by transverse partitions having openings 3*p*′ for the adjacent portions of the vibratory conveyor 13′ and for the layer of tobacco particles 7′ on the bottom wall 15′. The upper portion of the chamber 26′ (above the conveyor 13′) communicates with the lower portion of the chamber 27′ (below the conveyor 13′) by way of a suitably configurated conduit or pipe 29′. The upper portion of the chamber 27′ communicates with the lower portion of the chamber 28′ by a similar conduit or pipe 30′. The upper portion of the chamber 28′ has an outlet opening 32′ which discharges air into the atmosphere. A first sieve 35′ in the upper portion of the chamber 26′ prevents lighter particles of tobacco from entering the inlet of the conduit 29′. Similar sieves or filters 35′ are provided in the upper portion of the chambers 27′ and 28′ to respectively prevent lighter tobacco particles from entering the conduit 30′ and outlet opening 32′.

The lower portion of the chamber 26′ receives heated air by way of a pipe 31′ which is connected to the outlet of a blower 34′. The intake of the blower 34′ is connected with a suction pipe 74′ having an open end for admission of atmospheric air and an adjustable regulating valve or flap 77′ which can be pivoted by a servomotor 76′. Atmospheric air which enters the inlet of the suction pipe 74′ is heated by a preferably adjustable electric resistance heater 33′, and the temperature of heated air entering the blower 34′ can be regulated by changing the angular position of the flap 77′ which thereby admits a controlled quantity of unheated atmospheric air into the current of air which has passed the heater 33′.

The third section 4′ of the transporting system 1′ comprises a chamber 4*a*′ having side walls which are provided with openings 4*p*′ for the vibratory conveyor 13′. The lower portion of the chamber 4*a*′ (below the conveyor 13′) receives a homogenizing fluid (preferably air) by way of a pipe 36′ which receives air from a blower 41′. The intake of the blower 41′ is connected with a suction pipe 89′ which receives air from an elongated conduit or pipe 37′ communicating with the upper portion of the chamber 4*a*′. A sieve or filter 42′ in the upper portion of the chamber 4*a*′ prevents ligher tobacco particles from entering the inlet of the conduit 37′. The suction pipe 89′ contains an adjustable electric resistance heater 39′ and the air current flowing therein can receive controlled quantities of atomized water through the orifices of a nozzle 38′. 43′ here shown as an endless belt the upper stretch of which receives conditioned tobacco particles 44′ from the discharge end of the vibratory conveyor 13′. The belt 43′ transports conditioned tobacco to a further processing station, e.g., to a baling machine or to the magazine of a cigarette rod making machine, depending on the nature of tobacco particles 7′ which are being supplied by the feeding unit 1*a*′.

The moisture content of successive increments of tobacco in the trough of the vibratory conveyor 11′ is determined by a detector 46′, e.g., a detector known as HWK produced by Hauni-Werke of Hamburg-Bergedorf, Western Germany. The signals which are generated by the detector 46′ are transmitted to a signal comparing junction 52′ forming part of a control unit 51′ which constitutes a means for regulating the moisture content of the current of air flowing into the lower portion of the chamber 2*a*′. The junction 52′ is further connected with a potentiometer of another suitable rated value setting device 53′ which is adjustable to furnish signals indicating the desired or optimum initial moisture content of tobacco particles 7′ in the conveyor 11′. The output of the junction 52′ transmits a positive or negative signal when the intensity of signals furnished by the detector 46′ deviates from the intensity of signals applied by the potentiometer 53′.

The signal from the output of the junction 52′ is transmitted to a second signal comparing junction 54′ of the control unit 51′ as well as to one input of a signal comparing junction 66′ forming part of a second control unit 65′ which regulates the heater 24′ in the suction pipe 61′ of the blower 25′. The junction 54′ of the control unit 51′ further receives signals from a detector 56′ which is mounted in pipe 21′ and monitors the moisture content of the air current flowing into the lower portion of the chamber 2*a*′. The detector 56′ may constitute a conventional hygrometer. The signal from the output of the junction 54′ is indicative of the difference between the intensities of signals furnished by the junction 52′ and detector 56′, and is amplified by an amplifier 57′ which is in circuit with a variable-speed electric motor 58′ for a variable-delivery pump 59′ which supplies water to the atomizing nozzle 23′ in the suction pipe 61′. The pump 59′ draws water from a reservoir (not shown) via conduit 59*a*′.

The suction pipe 61′ is further provided with an adjustable regulating valve or flap 62′ which is located downstream of the heater 24′ and upstream of the nozzle 23′ (as considered in the direction of air flow from the conduit 22′ into the blower 25′) and whose position is adjustable by a servomotor 63′. The signals for adjustment of the flap 62′ via servomotor 63′ are supplied by the output of a threshold circuit 64′ which receives signals from the junction 54′ of the control unit 51′.

The potentiometer 53′ of the control unit 51′ is preferably adjusted in such a way that the current of air flowing into the lower portion of the chamber 2*a*′ is in a state of hygroscopic equilibrium with tobacco particles 7′ which are being supplied by the chute 20′ onto the leftmost part of the vibratory conveyor 13′. Thus, at least the major part of tobacco which is caused to travel through the chamber 2*a*′ does not accept moisture from and is not relieved of moisture by the current of air which is being supplied by the pipe 21′. The definition "hygroscopic equilibrium" need not necessarily indicate that the moisture content of tobacco in the chamber 2*a*′ is identical with or even close to the moisture content of air issuing from the pipe 21′. In fact, in most instances, the moisture content of air which is in a state of hydroscopic equilibrium with tobacco deviates considerably from (it is much higher than) the moisture content of tobacco. The difference between the moisture content of tobacco and the moisture content of air which is in a state of hygroscopic equilibrium with tobacco depends on a number of factors, especially the condition of tobacco (e.g., the nature and percentage of fluid and/or other matter which is confined in tobacco particles and the chemical composition of such other matter of fluid), the structure of tobacco (e.g., the formation of capillaries in the tissue of tobacco particles), and the brand of tobacco. For example, the composition of casing and/or the nature and percentage of salts in tobacco with influence that moisture content of air or another gas at which the gas is in a state of hygroscopic equilibrium with tobacco.

The signal which is transmitted from the junction 52′ of the control unit 51′ to the junction 66′ of the control unit 65′ is amplified by an amplifier 68′ which controls the heater 24′ in the suction pipe 61′ of the blower 25′. The junction 66′ further receives signals from a detector 67′ which is installed in the pipe 21′ and monitors the temperature of air flowing into the lower portion of the chamber 2a'. *The detector 67' may constitute a commercially available heat-sensitive PTC or NTC semiconductor.*

A further detector 71' (which may be identical with or similar to the detector 46') is adjacent to the path of conditioned tobacco particles 44' in the vibratory conveyor 11' immediately upstream of the take-off conveyor 43'. The detector 71' monitors the final moisture content of tobacco and transmits appropriate signals to a first input of a signal comparing junction 72' forming part of a third control control unit 73' for regulating the temperature of air entering the blower 34'. A second input of the junction 72' is connected with the output of an adjustable rated value setting device 75' (e.g., a potentiometer) which transmits a signal indicating the desired temperature of air which flows into the lower portion of the chamber 26'. The output of the junction 72' is connected with an amplifier 74' which transmits amplified signals to the servomotor 76' for the adjustable flap 77' in the suction pipe 74'.

The characteristics of air which is admitted into the lower portion of the chamber 4a' are determined by two control units 81' and 96'. The control unit 81' determines the exact moisture content of inflowing air, and the control unit 96' determines the exact temperature of such air. The difference between the control units 81' and 96 on the one hand and the control units 51' and 65' on the other hand is that the control units 81' and 96' are adjusted to insure that the final moisture content of tobacco particles (44') does not deviate from a desired or optimum value.

The control unit 81' comprises an adjustable rated value setting device 82' (e.g., a potentiometer) which transmits signals to one input of a signal comparing junction 84'. Another input of the junction 84' receives signals from a detector 83' which monitors the moisture content of air flowing in the pipe 36'. The signal at the output of the junction 84' is amplified by an amplifier 86' which is in circuit with a variable-speed electric motor 87' for a variable-delivery pump 88'. The latter supplies controlled quantities of water to the nozzle 38' in the suction pipe 89' of the blower 41' and is connected with a source of water by a conduit 88a'. The suction pipe 89' is provided with an adjustable regulating valve or flap 91' which is mounted between the heater 39' and nozzle 38' and is pivotable by a servomotor 93' receiving signals from a threshold circuit 92' which is connected to the output of the junction 84'.

The control unit 96' comprises an adjustable rated value setting device 97' (e.g., a potentiometer) which transmits signals of selected intensity to one input of a signal comparing junction 99'. Another input of the junction 99' is connected with a detector 98' which monitors the temperature of air in the pipe 36'. The signal from the output of the junction 99' is amplified by an amplifier 100' and regulates the heater 39' in the suction pipe 89'.

The operation of the conditioning apparatus of FIG. 5 is as follows:

The moisture content of tobacco particles 7' exceeds the desired moisture content of tobacco on the take-off conveyor 43'. The particles are delivered by the belt conveyer 8' in the form of a continuous stream which is equalized by the weighing device 12' and fed into the trough of the vibratory conveyor 11'. Thus, the conveyor 11' receives and discharges identical or nearly identical quantities of moist tobacco per unit of time. The detector 46 monitors the moisture content of tobacco particles 7' and transmits signals to the junction 52' of the control unit 51'. The detector 46' is a transducer which furnishes to the junction electric signals of varying intensity.

The conveyor 11' discharges tobacco particles 7' into or onto the chute 20' which supplies such particles into the leftmost part of the trough forming part of the vibratory conveyor 13', i.e., into the chamber 2a' of the first homogenizing section 2'. The holes 16' of the bottom wall 15' of the conveyor 13' permit the passage of small currents of conditioned air which is supplied by the pipe 21'. such currents cause the particles 7' of the stream on the bottom wall 15' to rise and to float within the confines of divergent side walls 17', 18' which insures a highly satisfactory conditioning of all sides of each tobacco particle 7'.

An important function of the first homogenizing section 2' is to insure a pronounced and reliable homogenization of tobacco which is being supplied by the feeding unit 1a'. Thus, the section 2' eliminates eventual differences in the moisture content of tobacco entering the chamber 2a' in response to signals furnished by the detector 46'. This insures that the drying action of air in the chambers 26', 27', 28' of the section 3' is highly satisfactory since the moisture content and temperature of tobacco particles 7' entering the chamber 26' are constant due to the homogenizing action of air currents passing through the holes 16' of the bottom wall 15' in the chamber 2a'.

The control unit 51' insures that the moisture content of air entering the pipe 21' changes as soon as the intensity of signals furnished by the detector 56' in the pipe 21' deviates from the intensity of signals furnished by the junction 52'. The control unit 65' insures that the heater 24' is adjusted (to effect a more or less pronouced heating of air supplied by the conduit 22') when the intensity of signals furnished by the detector 67' deviates from the intensity of signal supplied by the junction 52' (to junction 66'). Thus, not only the moisture content but also the temperature of air which flows in the pipe 21' is regulated by the initial moisture content of tobacco particles 7'. As mentioned above, the moisture content of air in the pipe 21' is selected with a view to insure that the air is in a state of hygroscopic equilibrium with tobacco in the chamber 2a', i.e., the air which enters and passes through the chamber 2a', should not remove moisture from or add moisture to tobacco which passes through the section 2' toward the chamber 26'. Changes in the moisture content of tobacco passing through the section 2' are not necessary since the main (and preferably the sole) purpose of air supplied by the blower 25' is to homogenize the tobacco before the particles 7' reach the drying section 3'. The homogenizing action of air in the chamber 2a' is regulated for the purpose of insuring that the moisture content of all particles 7' leaving the section 2' is identical with the moisture content of the bulk of tobacco particles supplied by the feeding unit 1a'. Such homogenizing action of the current of air which is circulated along the endless path defined by the pipe 21', chamber 2a', conduit 22', suction pipe 61' and blower 25' is very reliable whereby the characteristics of this current change very little since the air is not supposed to supply moisture to or remove moisture from tobacco particles 7'. Eventual fluctuations in moisture content of the just described air current are eliminated by the control unit 51 which regulates the admission of moisture via nozzle 23'. If the air flowing in the pipe 21' is so moist that its moisture content exceeds the desired value even if the admission of atomized water through the nozzle 23' is terminated, the signal from the output of the junction 54' causes the threshold circuit 64' to actuate the servomotor 63' which opens the flaps 62' to admit atmospheric air into the suction pipe 61' and to thereby reduce the moisture content of air which flows into the lower portion of the chamber 2a'. Such reduction in the moisture content of air in the pipe 21' takes place practically without delay.

The particles 7' of tobacco in the trough of the vibratory conveyor 13' form a floating stream which advances through the first opening 3p' and enters the first chamber 26' of the section 3'. Such particles are contacted from all sides by hot air which is being admitted by the pipe 31' to thus insure a pronounced exchange of energy and rapid drying of tobacco. The temperature of hot air entering the lower portion of the chamber 26' is regulated by the control unit 73' in response to signals furnished by the detector 71'. The drying is continued in the chambers 27' and 28' so that the moisture content of tobacco leaving the chamber 28' via first opening 4p' is normally reduced to a desired optimum value for further processing. The dimensions of the section 3' are relatively small which is desirale in a modern tobacco processing plant.

In order to insure a still more satisfactory homogenization or uniformizing of all characteristics of tobacco particles which leave the section 3', the conditioning apparatus includes the second homogenizing section 4' which is especially desirable when the section 3' is very short and compact, i.e., when the intensive drying of tobacco particles takes place withing a very short interval of time. The current of air which is circulated by the blower 41' has a constant temperature and moisture content (see the control units 96' and 81') and is in a state of hygroscopic equilibrium with tobacco in the chamber 4a'. Thus, the function of air in the chamber 4a' is analogous to that of air in the chamber 2a'.

The signal from the output of the junction 84' causes the threshold circuit 92' to actuate the servomotor 93' and to open the flap 91' in order to admit atmospheric air into the suction pipe 89' when the moisture content of air in the pipe 36' is excessive while the admission of water via nozzle 38' is interrupted. This results in practicaly instantaneous reduction of moisture content of air which enters the lower portion of the chamber 4a'.

The apparatus of FIGS. 5 and 6 exhibits the advantage that the interval which is required for the drying of tobacco (in the section 3') can be reduced still further without adversely affecting the desirable characteristics of the particles 44' which issue from the section 4'. This is attributed to homogenization in the sections 2' and 4', i.e., prior to and after drying in the chambers 26', 27' and 28'. Relatively short and compact drying means are desirable for a number of reasons.

Another advantage of the apparatus of FIG. 5 is that at least a portion of at least one of the homogenizing gas currents which contact tobacco particles in the chambers 2a' and 4a' is circulated along an endless path which intersects the path of tobacco particles in the respective portion of the vibratory conveyor 13'. This insures that the characteristics of the circulating gas current or currents must be altered very little or not at all with attendant savings in space and energy requirements of the apparatus. Thus, the control units 51', 65' and 81',96' are used to change the respective characteristics of the gas currents in the pipes 21' and 36' only when such characteristics deviate from an optimum or given value. The deviations would be much more pronounced if each of the pipes 31',36' would have to draw atmospheric air which would have to be conditioned prior to entry into the lower portion of the respective chamber 2a', 4a'. These control units are called upon to regulate the respective characteristics of gas currents in the pipes 21' and 36' only when the moisture content of incoming tobacco (conveyor 11' and chute 20') is not uniform and/or when the moisture content of tobacco leaving the chamber 28' is not uniform. Therefore, the control unit 51',65', 81' and/or 96' normally effects only minor changes in the respective characteristic of the corresponding gas current so that, and referring to the regulation of temperature by the flap 62' or 91', a minor change in the position of such flap suffices to rapidly change the temperature of the gas current in the pipe 21' or 36' to a desired value.

The conveyor 13' also contributes to a more intensive and reliable homogenizing and drying of tobacco particles by causing the particles to vibrate during transport through successive chambers so that the currents of air which are admitted via pipes 21',31' and 36' can contact all sides of each particle in the respective section of the transporting system. This insures an intensive exchange of heat energy and/or moisture between tobacco particles and gas currents.

The gas current which enters the lower portion of the chamber 4a' homogenizes the particles of tobacco in the respective portion of the conveyor 13' (when necessary) so that the temperature of particles leaving the section 4' equals the temperature of gas in the chamber 4a', either by heating or by cooling the conveyed fibrous material. At least the major portion of tobacco in the chamber 4a' does not receive additional moisture and is not relieved of moisture so that the gas in the chamber 4a' supplies moisture to or withdraws moisture from a small portion of tobacco but does not change the moisture content of the major portion of material on the conveyor 13'.

The treatment of tobacco in the chamber 2a' does not affect the flexibility of particles 7' so that such particles are not comminuted during transport toward the take-off conveyor 43'. In fact, such treatment (by the current of gas entering the chamber 4a' via pipe 21') enhances the elasticity of tobacco particles while the particles are homogenized prior to entering the first chamber 26' of the section 3'.

Still another advantage of the conditioning apparatus of FIG. 5 is that it can dispense with the vibratory conveyors 7, 8 of FIG. 1 and with the corresponding conveyors of FIG. 3 or 4. This allows for a reduction of the dimensions of the chamber 2a' with attendant savings in space and lesser problems in connection with sealing of the chamber. As regards the homogenizing action prior to actual drying, such homogenizing action is performed by the entire gas current which enters the chamber 2a' via pipe 21', and in part by the gas current which enters the chamber 6, 106 or 306 via pipe 39, 139 or 339. As mentioned above, the gas current in the chamber 6, 106 or 306 reaches or can reach a state of hygroscopic equilibrium with tobacco on the uppermost or median conveyor of the section 2, 102 or 302.

Without further analysis, the foregoing will so fully reveal the gist of the present invention that others can, by applying current knowledge, readily adapt it for various applications without omitting features which fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended

1. A method of drying tobacco with a gaseous fluid, comprising the steps of transporting moist tobacco particles along a predetermined path; subjecting the particles to the action of a first current of flowing moisture containing medium which is conveyed substantially transversely across a first portion of said path; thereupon subjecting the particles to the action of a hot second gas current which is conveyed substantially transversely across a second portion of said path; monitoring the moisture content of tobacco downstream of said second portion of said path; and respectively intensifying and reducing the heating action of said second gas current when the monitored moisture content is respectively higher than and below a predetermined value.

2. A method as defined in claim 1, wherein said transporting step comprises vibrating the particles of tobacco in at least one portion of said path so that the particles in said one portion of said path are transported in the form of a layer of agitated floating particles.

3. A method as defined in claim 1, further comprising the step of gradually reducing the speed of at least one of said currents during contact with particles in the respective portion of said path.

4. In an apparatus for drying tobacco with a gaseous fluid, a combination comprising means for transporting moist tobacco particles along an elongated path, said transporting means comprising a plurality of successive sections defining successive portions of said path; means for contacting the particles of tobacco with a first current of flowing moisture containing medium in a first section of said transporting means, including means for conveying said first current substantially transversely of the respective portion of said path; means for subjecting the particles of tobacco to the action of a hot second gas current in a second section of said transporting means, including means for conveying said second current substantially transversely of the respective portion of said path; means for monitoring the moisture content of tobacco particles downstream of said second section; and means for adjusting said means for subjecting the particles to the action of said second gas current as a function of deviations of monitored moisture content from a predetermined value to respectively intensify and reduce the action of said second gas current when the monitored moisture content respectively exceeds and is below said predetermined value.

5. A combination as defined in claim 4, wherein said transporting means comprises means for vibrating the particles of tobacco in at least one of said first and second sections so that the particles in said one section form a layer of agitated floating particles.

6. A combination as defined in claim 4, further comprising means for gradually reducing the speed of at least one of said gas currents during contact with tobacco particles in the respective section of said transporting means.

* * * * *